US006074444A

United States Patent [19]

Bingley

[11] Patent Number: 6,074,444

[45] Date of Patent: Jun. 13, 2000

[54] ADDITIVE COMPOSITION

[76] Inventor: Michael Stanley Bingley, Eaton Farm, Miles Lane, Cobham, Surrey, United Kingdom, KT11 2ED

[21] Appl. No.: 09/223,982

[22] Filed: Jan. 4, 1999

Related U.S. Application Data

[63] Continuation of application No. PCT/GB97/01771, Jul. 1, 1997.

[30] Foreign Application Priority Data

Jul. 1, 1996 [GB] United Kingdom ..... 9613756

[51] Int. Cl.[7] ..... C10L 1/28

[52] U.S. Cl. ..... 44/320; 44/354

[58] Field of Search ..... 44/320, 354

[56] References Cited

U.S. PATENT DOCUMENTS

| | | | |
|---|---|---|---|
| 2,160,273 | 5/1939 | Loane | 508/567 |
| 2,560,542 | 7/1951 | Bartleson et al. | 508/351 |
| 2,809,162 | 10/1957 | Lowe | 508/414 |
| 2,960,469 | 11/1960 | Young | 508/498 |
| 4,659,338 | 4/1987 | Johnston et al. | 44/347 |
| 4,690,687 | 9/1987 | Johnston et al. | 44/373 |
| 4,804,389 | 2/1989 | Johnston et al. | 44/403 |
| 5,055,211 | 10/1991 | Habeeb et al. | 508/364 |

FOREIGN PATENT DOCUMENTS

| | | |
|---|---|---|
| 0006000 | 12/1979 | European Pat. Off. . |
| 2222403 | 10/1974 | France . |
| 46-018269 | 5/1971 | Japan . |
| 866054 | 4/1961 | United Kingdom . |
| 0947609 | 1/1964 | United Kingdom . |
| 2021609 | 5/1979 | United Kingdom . |
| 2203750 | 10/1988 | United Kingdom . |

*Primary Examiner*—Jacqueline V. Howard
*Assistant Examiner*—Cephia D. Toomer
*Attorney, Agent, or Firm*—Baker Botts L.L.P.

[57] ABSTRACT

An additive composition for use in internal combustion engines and which can be added to the fuel or lubricating oil comprises a silicone oil and an organic titanium compound such as an organic titanate, optionally with a solvent and lubricating oil, the additive composition reduces valve and valve gear wear with lead free fuels, improves exhaust emission quality and decreases engine wear.

8 Claims, No Drawings

ADDITIVE COMPOSITION

This application is a continuation of PCT/GB97/01771 filed Jul. 1, 1997 which is incorporated by reference herein.

BACKGROUND OF THE INVENTION

The present invention relates to fuel additives for hydrocarbon fuels, which can improve the operation and performance of internal combustion engines, particularly those used in motor vehicles.

Fuel additives of various types, which improve the performance of internal combustion engines such as improved power and torque output and improved fuel consumption have been proposed and used. Other fuel additives, such as detergents and anti-wear additives have improved the cleanliness and life of an engine and its components.

In EP0006000, there is disclosed a composition which comprises a lubricating oil, which incorporates a silicone fluid and this composition can be added to gasoline. The composition is stabilised by a magnetic or heat treatment.

When this composition was used as a gasoline additive, it was found to give improved fuel consumption and greater engine cleanliness.

Lead has been the most wide used additive for use in gasoline to give improved anti-knock performance, however the health risks associated with lead has resulted in the phasing out of lead in gasoline. As well as its anti-knock performance gasoline containing lead has been found to give improved valve and valve seat wear compared to lead free gasoline. In modern engines hardened valves and valve seats etc. are used to reduce valve seat and valve wear, but in many engines, particularly older engines, the removal of lead from gasoline gives rise to serious problems with valve and valve seat wear.

Many additives have been suggested to replace lead in gasoline and at some stage almost every metal in some form or compound has been suggested to replace lead, however in spite of claims, none has been found to be entirely satisfactory.

SUMMARY OF THE INVENTION

We have now devised an improved composition containing a silicone which can be used as a fuel or oil additive.

According to the invention there is provided a composition which comprises a silicone oil and an organic titanium compound.

The invention also provides a lubricating oil which comprises a mineral lubricating oil, a silicone oil and an organic titanium compound.

The invention further provides a fuel composition which comprises a hydrocarbon fuel such as gasoline, diesel fuel, gas oil, etc. and a lubricating composition as above.

DETAILED DESCRIPTION OF THE PREFERRED EMBODIMENTS

When a titanium compound is added to a silicone oil or a solution containing a concentrated silicone oil a chemical reaction normally takes place and a precipitate or other compound is formed which renders the mixture unsuitable for use.

We have discovered that if the silicone oil and the titanium compound are added separately to the gasoline in the amounts to be used this reaction does not take place on mixing. However it is believed that at the sparking plug a the titanium compound and the silicone oil react together to give a complex which acts as a catalyst and gives improved combustion characteristics.

Surprisingly it has been found that the use of unleaded fuel containing the additive formulation of the invention gives unexpectedly good emission levels. The levels achieved are comparable to those required by cars utilising catalytic converters and can result in cars which otherwise would be unable to meet the required emission levels being able to be used.

The silicone oil can be any conventional silicone oil, preferably the oil has a viscosity of the same order as mineral lubricating oils over ambient and operating temperature ranges.

Examples of silicone oils are phenyl silicones, homologous series silicones or halogenated silicones may be used but preferably the silicone used in the invention is a dimethyl silicone. Particularly good results have been achieved with a half and half mixture of dimethyl silicone fluid, having a nominal viscosity of 300 centi-stokes at 25° C. and a dimethyl silicone fluid having a nominal viscosity of 50 centistokes at 25° C.

When a silicone oil composition is provided which incorporates a lubricating oil the lubricating oil which is used in forming the silicone oil composition may be any suitable mineral, vegetable or synthetic oil, such as, for example, any paraffinic or naphthenic mineral lubricating oil, castor oil, polyisopropylene, or polyisobutylene etc. Preferably however, the oil will be a paraffinic mineral oil and may comprise a mixture of different paraffinic mineral oils. For best results, the oil or oils used in the method in accordance with the invention, should be substantially free of water (less than 30 parts per million by weight) and should preferably have a sulphur content which is less than 1%, preferably less than 0.3% by weight. Most standard SAE 30 paraffinic oils which are on sale, should be satisfactory from this point of view, particularly in respect of the low water contents.

The silicone which is used in the method in accordance with the invention preferably has a molecular chain length which substantially matches that of the oil or, in other words, the viscosities of the silicone and the oil are preferably of the same order as each other, at least over the normal ambient and operating temperature range.

At normal temperatures, however, silicones and oil do not mix at all well and, although the silicone will dissolve in the oil if the temperature is raised high enough, it will be usual for the suspension to be formed by mixing together the silicone, the oil and a solvent in which the silicone is at least partly soluble.

The solvent, when used, is preferably perchloroethylene, which may be of an industrial or analytical grade but other common aliphatic solvents or aromatic solvents may be used, such as carbon tetrachloride, chloroform, ethylene dichloride, trichiorethylene, benzene, toluene, xylene, diethyl ether, di-isopropyl ether or white spirit. To a lesser extent, cyclohexane, petroleum ether, petrol, amyl acetate, petroleum spirit, 2-ethylhexanol, dioxane or diethyl cellosolve may be used and possible some of the alcohol series may be used, provided the silicone can be made to go into at least partial solution.

When it is intended that a silicone oil made in accordance with the invention is to be used as a two-stroke oil or as an upper cylinder lubricant for four-stroke petrol engines and diesel engines or indeed as an engine sump oil, the silicone oil produced preferably comprises, by volume not more than 1% silicone, not more than 4% solvent and oil (including any other additives which may be considered desirable) as the remainder. It is thought that adding silicone in an amount as little as 0.001% to an oil by the method in accordance with the invention, will have some effect in improving the lubricating properties of the oil but generally the silicone oil should contain not less than 0.02% silicone. Preferably the silicone oil will contain about 0.2% silicone and at least 0.4% solvent.

The organic titanium compound is preferably a compound which is soluble in, or can be held in, suspension in the oil composition. Suitable compounds include organic titanates such as octylene glycol titanate, butyl titanate, polybutyl titanate, tetramonyl titanate and tetra iso-octyl titanate. The titanium compound can be added to the gasoline separately in oil solution or in a gasoline solution or as the compound itself. As referred to above it is important that the titanium compound and the silicone oil are not mixed until they are both in the gasoline.

The titanate is preferably present in the gasoline in an amount of 50–150% by volume, based on the volume of the silicone oil or silicone oil plus lubricating oil, as the case may be.

The lubricating oil/silicone oil composition can be made using the methods disclosed in EP 0006000, including subjecting the composition to magnetic or heat treatment to improve the performance of the composition.

The compositions of the present invention can be used as a lubricating oil additive, in which case it is added to the sump oil. They can also be used as two-stroke oils or as additives to two-stroke oils and as fuel additives, when they can be added to the fuel either during the blending of the fuel or in a tank, e.g. as an upper cylinder lubricant.

If desired, however, the compositions according to the invention hereinbefore described, may be used on their own as an engine oil additive, which is rich in silicone and which would be added in small amounts to ordinary sump oils as required. In this case, the additive would comprise, by volume, not more than 20% silicone, not more than 40% oil and solvent as the remainder, it being the intention for such an additive to be added to sump oil in an amount of from 1 to 5% by volume of the sump oil. The manufacture of the additive would be exactly the same as for the oil compositions described in EP 0006000 earlier. In this case, the oil will preferably be a mixture of paraffinic technical white oil and an SAE 30 paraffinic mineral oil, preferably in the ratio of 4:1. Generally, it is thought that the silicone and solvent contents will be less for a diesel engine sump oil additive than for a petrol engine sump oil additive.

The compositions of the invention, when used as a lubricating oil additive or fuel additive, can give improved fuel consumption, lower running temperatures, enhanced anti-knock characteristics and improved engine cleanliness.

EXAMPLE 1

Preparation of the Silicone Oil Composition

A dimethyl silicone mixture was made, consisting of 50% dimethyl silicone fluid, obtainable from ICI as F111/50 (having a nominal viscosity of 50 centistokes at 25° C.) and 50% dimethyl silicone fluid obtainable from ICI as F111/300 (having a nominal viscosity of 300 centistokes at 25° C.). In addition, a carrier oil mixture was made, consisting of, by volume, 80% paraffinic technical white oil and 20% of a standard SAE 30 paraffinic oil. This oil was obtained as SAE 30 Castrol 110A and had a water content less than 30 parts per million by weight and a sulphur content less than 0.3% by weight.

The dimethyl silicone mixture and the carrier oil mixture were then used together with some perchloroethylene to make a silicone-rich carrier consisting of, by volume, 20% dimethyl silicone. 30% carrier oil and 50% perchloroethylene. In making the silicone-rich carrier, the carrier oil and the perchloroethylene were mixed together, without the silicone mixture and heated in a suitable vessel to 127° C., which is the boiling point of perchloroethylene. After allowing time for the oxygen in the vessel to be driven off, the dimethyl silicone mixture was added directly to the contents of a vessel by syringe. Boiling was maintained for a short while to ensure that the silicone mixed completely with the oil and solvent and to prevent air from re-entering the vessel, The vessel was then sealed and the mixture allowed to cool slowly in the absence of oxygen. The resulting mixture was the silicone-rich carrier.

A standard SAE 30 paraffinic mineral oil (obtained as SAE 30 Castrol 110A) was then used as a base lubricating oil to which the silicone-rich carrier was added to form a silicone oil, as follows. The base oil was placed in a closed vessel and heated to a temperature of 60° C., while continuously agitating the oil, air being allowed to escape from the vessel but not to enter. When 60° C. was reached, a small quantity of the silicone-rich carrier was added to the base oil in the vessel, the quantity being 5% by volume, of the total mixture and the vessel was sealed after the remaining air had been expelled. The mixture of the base oil and the silicone-rich carrier in the vessel was agitated continuously for about 15 minutes at 60° C. before being allowed to cool slowly in the absence of oxygen. The resulting mixture was a high quality silicone oil containing, by volume, 0.2% silicone, 3.5% perchloroethylene, 1.04% technical white oil and the SAE 30 paraffinic oil as the remainder.

It is a feature of the present invention that the additives contain no toxic or harmful components compared with the heavy metal additives which have been suggested.

The invention is described with reference to the following example:

EXAMPLE 2

Preparation of the Compositions of the Invention

Equal quantities of the silicone oil composition prepared as in Example 1 and octylene glycol titanate were added separately to lead-free petrol in proportion of 4 ccs of the combined additives to 1 gallon of gasoline. In a test run in an internal combustion engine, the fuel composition gave a lower running temperature, knock-free running, an increase in power and an absence of carbonaceous deposits in the combustion chamber, compared with the same fuel without the additives.

Tests

A 1975 125 bhp Triumph TR6 was run on the fuel composition of Example 2. The TR6 has an engine which was believed to be unable to run on the lead free gasoline commercially available and road trials of this car with the gasoline of Example 2 without the additives of the invention included, knocked when running and inspection after a short distance found excessive valve seat wear. Visual inspection of the exhaust of the engine showed smoky exhaust indicating unburnt hydrocarbons and passing the exhaust over a fibre filter showed sever discolouring. The car was run on the gasoline formulation of Example 2 and ran over 40,000 miles with no knock, substantially little valve seat wear and with no problems; passing the exhaust over the fibre filter showed very low levels of discolouring. It was also found that the engine could run on weaker mixtures than the original specification with no problems, the engine was also found to have excellent emission characteristics which may be due to the weaker mixture being able to be used.

The emissions of the engine running on petrol incorporating the additive were measured and the results shown below.

Test 1 CO Emission

The Vehicle was a 1972 TR6 Commission no. CP76096-0. The fuel used was commercial 95 Octane lead free petrol. The car was run under good weather conditions. The test was carried out on the move using a German Blue Point meter which was powered by the vehicle's 12 volt power supply. The exhaust gas was taken to the meter. The engine was brought up to operating temperature with the vehicle stationary, revving at 800 rpm and the CO emission was measured at 0.1%.

The running test comprised:

1. Cruising on level ground at 30 m.p.h.: emission fluctuating <0.1%
2. Cruising on level ground at 55 m.p.h.: emission 0.00%
3. Climbing at 35 m.p.h., on change down from 3rd to 2nd gear emission changed from 0.00%, momentarily to 1.4% dropping back to 0.1%. total time of change 2 seconds.

During the 30 min run the only time the emission exceeded 0.1% was on the climb.

These results are below the level for the UK MOT test for cars fitted with a catalytic converter.

Test 2 Exhaust Emissions

The engine was tested on the bench for CO; $CO_2$; $O_2$ and HC on stream. Prior to commencement of the test, all instruments, purges and activated N2 for zero gas and the following span gas levels used for calibration and drift correction.

HC Hexane in N2 1435 vpm (volume parts per million)

CO in $N_2$ 2.651% (26510 vpm)

COhd 2in $N_2$ 15.014% (15014 vpm)

$O_2$ in $N_2$ 4.967% (49670 vpm)

Method: A ¼" bore stainless steel tube was inserted 24" into one of the two open tail pipes, this tube, via a quick fit connector was fed directly to the gas bench where the sample was filtered, refrigerated etc.

The vehicle was thoroughly warmed up and set on the idle mode where it ran for five minutes prior to the commencement of readings being taken Results

| Time | CO vpm | $CO_2$ % | $O_2$ % | HC vpm |
|---|---|---|---|---|
| 12.28 | 2951 | 15.08 | 5.7 | 206/200 |
| 12.30 | 3190 | 15.80 | 5.75 | 155 |

-continued

Results

| Time | CO vpm | $CO_2$ % | $O_2$ % | HC vpm |
|---|---|---|---|---|
| 12.32 | 3022 | 15.90 | 5.74 | 163 |
| 12.34 | 2892 | 16.01 | 5.86 | 167 |
| 12.36 | 3092 | 16.61 | 5.82 | 185 |
| Average levels | 2879.8 | 15.88 | 5.774 | 175.2 |

For comparison a reference was taken with Ford Fiesta 1.1 liter which had an advanced engine to reduce emissions.

| CO vpm | $CO_2$ % | $O_2$ % | HC vpm |
|---|---|---|---|
| 2450 | 16.8 | 3.45 | 305 |

As can be seen the use of the additive of the invention enabled a 1976 engine to be have emission characteristics up to the level of modern engines.

I claim:

1. A fuel composition which comprises a liquid hydrocarbon fuel, a silicone oil and an organic titanium compound, wherein the organic titanium compound is present in the fuel in an amount of 50–150% by volume, based on the volume of the silicone oil.

2. A fuel composition as claimed in claim 1 further comprising a lubricating oil.

3. A fuel composition as claimed in claim 1 wherein the silicone oil is a dimethyl silicone.

4. A fuel composition as claimed in claim 3 wherein the silicone oil is a half and half mixture of a dimethyl silicone fluid, having a nominal viscosity of 300 centi-stokes at 25° C. and a dimethyl silicone fluid having a nominal viscosity of 50 centistokes at 25° C.

5. A fuel composition as claimed in claim 1 wherein the organic titanium compound is a compound selected from the group consisting of a compound which is soluble in the fuel composition and a compound which can be held in suspension in the fuel composition.

6. A fuel composition as claimed in claim 5 wherein the organic titanium compound is selected from the group consisting of octylene glycol titanate, butyl titanate, polybutyl titanate, tetramonyl titanate and tetra iso-octyl titanate.

7. A fuel composition as claimed in claim 1 wherein the silicone oil is present in an amount of from 0.0% to 1.5% by volume of the fuel.

8. A fuel composition as claimed in claim 5 wherein the silicone oil is present in an amount of 0.01% to 1.5% by volume of the fuel.

* * * * *